US010428445B2

(12) United States Patent
Agarwal

(10) Patent No.: US 10,428,445 B2
(45) Date of Patent: Oct. 1, 2019

(54) PRODUCTION OF HIGH COTTON NUMBER OR LOW DENIER CORE SPUN YARN FOR WEAVING OF REACTIVE FABRIC AND ENHANCED BEDDING

(71) Applicant: Arun Agarwal, Dallas, TX (US)

(72) Inventor: Arun Agarwal, Dallas, TX (US)

( * ) Notice: Subject to any disclaimer, the term of this patent is extended or adjusted under 35 U.S.C. 154(b) by 45 days.

(21) Appl. No.: 15/622,052

(22) Filed: Jun. 13, 2017

(65) Prior Publication Data

US 2017/0275787 A1 Sep. 28, 2017

Related U.S. Application Data

(62) Division of application No. 15/069,982, filed on Mar. 15, 2016, now Pat. No. 9,708,736.

(51) Int. Cl.
*D02G 1/08* (2006.01)
*D03D 15/08* (2006.01)
(Continued)

(52) U.S. Cl.
CPC ..... *D02G 1/08* (2013.01); *D02G 1/0266* (2013.01); *D02G 1/16* (2013.01); *D02G 1/161* (2013.01);
(Continued)

(58) Field of Classification Search
CPC ..... D02G 1/08; D02G 1/161; D02G 1/165; D02G 3/324; D02G 3/328; D02G 3/36; D02G 3/367
See application file for complete search history.

(56) References Cited

U.S. PATENT DOCUMENTS 1,334,901 A 3/1920 Higdon
2,505,027 A 7/1946 Belsky
(Continued)

FOREIGN PATENT DOCUMENTS

CA 2155880 A1 2/1997
CA 2346947 A1 5/2000
(Continued)

OTHER PUBLICATIONS

"Woven Fabrics and Ultraviolet Protection", University of Maribor, Faculty of Mechanical Engineering, Slovenia on Aug. 18, 2010 by Polona Dobnik Dubrovski (pp. 25) http://cdn.intechopen.com/pdfs-wm/12251.pdf.

(Continued)

*Primary Examiner* — Shaun R Hurley
(74) *Attorney, Agent, or Firm* — LegalForce RAPC Worldwide

(57) ABSTRACT

A method includes drawing a roving thread from a roving bobbin through a roving guide, an aft drafting roller, and a mid drafting roller to a front drafting roller, and drawing a spandex core from a spandex bobbin using a guide roller. The method also includes associating the roving thread and the spandex core by drawing the roving thread and the spandex core in an approximately parallel fashion through the front drafting roller, and drawing the associated roving thread and the spandex core through a lappet hook and an anti-ballooning guide. Further, the method includes winding the drawn associated roving thread and the spandex core on a ring-frame bobbin including a ring traveler attached to a rotatable ring. The circular motion of the ring traveler around the ring-frame bobbin causes the drawn associated roving thread to twist around the drawn associated spandex core, forming a core spun yarn.

3 Claims, 5 Drawing Sheets

(51) Int. Cl.

| | |
|---|---|
| ***D02G 1/16*** | (2006.01) |
| ***D02G 3/32*** | (2006.01) |
| ***D03D 13/00*** | (2006.01) |
| ***D03D 15/00*** | (2006.01) |
| ***D02G 1/02*** | (2006.01) |

(52) U.S. Cl.

CPC ..... *D02G 1/165* (2013.01); *D02G 3/324* (2013.01); *D02G 3/328* (2013.01); *D03D 13/008* (2013.01); *D03D 15/0027* (2013.01); *D03D 15/08* (2013.01); *D10B 2201/02* (2013.01); *D10B 2331/10* (2013.01); *D10B 2401/061* (2013.01); *D10B 2503/06* (2013.01)

(56) References Cited

U.S. PATENT DOCUMENTS

| | | | |
|---|---|---|---|
| 2,451,533 | A | 10/1948 | Haven |
| 2,483,861 | A | 10/1949 | Weiss |
| 2,624,893 | A | 1/1953 | Harris |
| 2,662,234 | A | 12/1953 | Citron |
| 2,782,130 | A | 2/1957 | Ness et al. |
| 2,788,291 | A | 4/1957 | Stertz |
| 2,942,280 | A | 6/1960 | May, Jr. |
| 2,963,715 | A | 12/1960 | Young |
| 2,971,095 | A | 2/1961 | Warren |
| 3,027,573 | A | 4/1962 | Bell, Jr. |
| 3,081,197 | A | 3/1963 | Adelman |
| 3,144,666 | A | 8/1964 | Clark et al. |
| 3,265,527 | A | 8/1966 | Adelman |
| 3,441,063 | A | 4/1969 | Naimer et al. |
| 3,489,591 | A | 1/1970 | Cardarelli |
| 3,536,920 | A | 10/1970 | Krol et al. |
| 3,632,383 | A | 1/1972 | Dominick |
| 3,694,832 | A | 7/1972 | Jamison |
| 3,721,274 | A | 3/1973 | Sherrill et al. |
| 3,774,250 | A | 11/1973 | Miller |
| 3,789,469 | A | 2/1974 | Kodama |
| 3,828,544 | A | 8/1974 | Alker |
| 4,002,427 | A | 1/1977 | Moller et al. |
| 4,042,986 | A | 8/1977 | Goodman et al. |
| 4,085,903 | A | 4/1978 | Kuhnemann |
| 4,191,221 | A | 3/1980 | Boyer |
| 4,196,355 | A | 4/1980 | Maine |
| 4,279,045 | A | 7/1981 | Vitale |
| 4,338,693 | A | 7/1982 | Vitale |
| 4,352,380 | A | 10/1982 | Owen |
| 4,422,195 | A | 12/1983 | Russo et al. |
| 4,429,094 | A | 1/1984 | Massucco |
| 4,485,838 | A | 12/1984 | Shoji et al. |
| 4,496,619 | A | 1/1985 | Okamoto |
| 4,534,819 | A | 8/1985 | Payet |
| 4,546,493 | A | 10/1985 | Bortnick |
| 4,578,306 | A | 3/1986 | Heiman |
| 4,621,489 | A | 11/1986 | Okada |
| 4,634,625 | A | 1/1987 | Franklin |
| 4,651,370 | A | 3/1987 | Vitale |
| 4,662,013 | A | 5/1987 | Harrison |
| 4,670,326 | A | 6/1987 | Heiman |
| 4,672,702 | A | 6/1987 | Isham |
| 4,682,379 | A | 7/1987 | Dugan |
| 4,703,530 | A | 11/1987 | Gusman |
| 4,724,183 | A | 2/1988 | Heiman |
| 4,727,608 | A | 3/1988 | Joyce |
| 4,734,947 | A | 4/1988 | Vitale |
| 4,742,788 | A | 5/1988 | Dugan |
| 4,777,677 | A | 10/1988 | Dugan |
| 4,802,251 | A | 2/1989 | O'Dell |
| 4,825,489 | A | 5/1989 | Ross |
| 4,839,934 | A | 6/1989 | Rojas |
| 4,853,269 | A | 8/1989 | Fukumori |
| 4,861,651 | A | 8/1989 | Goldenhersh |
| 4,896,406 | A | 1/1990 | Weingarten et al. |
| 4,903,361 | A | 2/1990 | Tang |
| 4,912,790 | A | 4/1990 | MacDonald |
| 4,962,546 | A | 10/1990 | Vitale |
| 4,962,554 | A | 10/1990 | Tesch |
| 4,980,564 | A | 12/1990 | Steelmon et al. |
| 4,980,941 | A | 1/1991 | Johnson, III |
| 4,985,953 | A | 1/1991 | Seago et al. |
| 5,010,610 | A | 4/1991 | Ackley |
| 5,010,723 | A | 4/1991 | Wilen |
| 5,020,177 | A | 6/1991 | Etherington |
| 5,029,353 | A | 7/1991 | Kimball et al. |
| 5,046,207 | A | 9/1991 | Chamberlain |
| 5,056,441 | A | 10/1991 | Seago et al. |
| 5,070,915 | A | 12/1991 | Kalin |
| 5,092,006 | A | 3/1992 | Fogel |
| 5,103,504 | A | 4/1992 | Dordevic |
| 5,161,271 | A | 11/1992 | Gronbach |
| 5,167,114 | A | 12/1992 | Stahlecker |
| 5,191,777 | A | 3/1993 | Schnegg |
| 5,217,796 | A | 6/1993 | Kasai et al. |
| 5,244,718 | A | 9/1993 | Taylor et al. |
| 5,249,322 | A | 10/1993 | Seago |
| 5,275,861 | A | 1/1994 | Vaughn |
| 5,285,542 | A | 2/1994 | West et al. |
| 5,287,574 | A | 2/1994 | Kardell et al. |
| 5,325,555 | A | 7/1994 | Whitley |
| 5,364,683 | A | 11/1994 | Flint et al. |
| 5,400,831 | A | 3/1995 | Gheysen |
| 5,414,913 | A | 5/1995 | Hughes |
| 5,465,760 | A | 11/1995 | Mohamed et al. |
| 5,487,936 | A | 1/1996 | Collier |
| 5,488,746 | A | 2/1996 | Hudson |
| 5,495,874 | A | 3/1996 | Heiman |
| 5,503,917 | A | 4/1996 | Hughes |
| 5,524,841 | A | 6/1996 | Rijk et al. |
| 5,530,979 | A | 7/1996 | Whitley |
| 5,531,985 | A | 7/1996 | Mitchell et al. |
| 5,542,137 | A | 8/1996 | Byfield |
| 5,625,912 | A | 5/1997 | McCain et al. |
| 5,628,062 | A | 5/1997 | Tseng |
| 5,635,252 | A | 6/1997 | Fraser, Jr. et al. |
| 5,642,547 | A | 7/1997 | Hutton et al. |
| 5,657,798 | A | 8/1997 | Krummheuer et al. |
| 5,729,847 | A | 3/1998 | Allardice |
| 5,765,241 | A | 6/1998 | MacDonald |
| 5,795,835 | A | 8/1998 | Bruner et al. |
| 5,809,593 | A | 9/1998 | Edwards |
| 5,843,542 | A | 12/1998 | Brushafer et al. |
| 5,869,193 | A | 2/1999 | Langley |
| 5,884,349 | A | 3/1999 | Gretsinger |
| 5,906,004 | A | 5/1999 | Lebby et al. |
| 5,932,494 | A | 8/1999 | Crippa |
| 5,968,854 | A | 10/1999 | Akopian et al. |
| 5,985,773 | A | 11/1999 | Lee |
| 5,996,148 | A | 12/1999 | McCain et al. |
| 6,025,284 | A | 2/2000 | Marco et al. |
| 6,034,003 | A | 3/2000 | Lee |
| 6,037,280 | A | 3/2000 | Edwards et al. |
| 6,098,219 | A | 8/2000 | Milber |
| 6,148,871 | A | 11/2000 | Hassell et al. |
| 6,164,092 | A | 12/2000 | Menaker |
| 6,243,896 | B1 | 6/2001 | Osuna et al. |
| 6,281,515 | B1 | 8/2001 | Demeo et al. |
| 6,318,060 | B1 * | 11/2001 | Dinkelmann ..... D01H 1/025 19/244 |
| 6,338,367 | B1 | 1/2002 | Khokar |
| 6,353,947 | B1 | 3/2002 | McCain et al. |
| 6,369,399 | B1 | 4/2002 | Smirnov |
| 6,440,555 | B1 | 8/2002 | Yuuki et al. |
| 6,460,322 | B1 * | 10/2002 | Sato ..... D02G 3/324 57/225 |
| 6,468,655 | B1 | 10/2002 | Kato et al. |
| 6,499,157 | B1 | 12/2002 | McCain et al. |
| 6,610,395 | B2 | 8/2003 | Rohrbach et al. |
| 6,689,461 | B2 | 2/2004 | Koyanagi et al. |
| 6,823,544 | B2 | 11/2004 | Treece |
| 6,934,985 | B2 | 8/2005 | Sanders |
| 7,032,262 | B2 | 4/2006 | Creech |
| 7,070,847 | B2 | 7/2006 | Efird et al. |
| 7,111,648 | B2 | 9/2006 | Mitchell et al. |
| 7,140,053 | B1 | 11/2006 | Mangano |

(56) References Cited

U.S. PATENT DOCUMENTS

| | | | | |
|---|---|---|---|---|
| 7,143,790 | B2 | 12/2006 | Liao | |
| 7,181,790 | B2 | 2/2007 | Wirtz | |
| 7,325,263 | B2 | 2/2008 | Stribling | |
| 7,398,570 | B2 | 7/2008 | Seago | |
| 7,445,177 | B2 | 11/2008 | Wittmann et al. | |
| 7,476,889 | B2 | 1/2009 | Demeo et al. | |
| 7,484,538 | B2 | 2/2009 | Barratte | |
| 7,501,364 | B2 | 3/2009 | Bouckaert et al. | |
| 7,628,180 | B1 | 12/2009 | Golz | |
| 7,673,656 | B2 | 3/2010 | Heiman | |
| 7,682,994 | B2 | 3/2010 | Van Emden et al. | |
| 7,726,348 | B2 | 6/2010 | Heiman | |
| 7,762,287 | B2 | 7/2010 | Liao | |
| 7,816,288 | B2 | 10/2010 | Leonard et al. | |
| 7,856,684 | B2 | 12/2010 | Robertson et al. | |
| 7,913,483 | B2 * | 3/2011 | Qiu | D01H 1/006 57/10 |
| 8,053,379 | B2 | 11/2011 | Tingle et al. | |
| 8,171,581 | B2 | 5/2012 | Agarwall | |
| 8,186,390 | B2 | 5/2012 | Krishnaswamy et al. | |
| 8,230,537 | B2 | 7/2012 | Stewart et al. | |
| 8,267,126 | B2 | 9/2012 | Rabin et al. | |
| 8,278,227 | B2 | 10/2012 | Shibaoka et al. | |
| 8,334,524 | B2 | 12/2012 | Demeo et al. | |
| 8,544,252 | B2 * | 10/2013 | Tao | D01H 1/11 57/336 |
| 8,566,983 | B2 | 10/2013 | Monaco | |
| 8,624,212 | B2 | 1/2014 | Yang et al. | |
| 8,627,521 | B2 | 1/2014 | Rowson et al. | |
| 8,640,282 | B2 | 2/2014 | Maguire et al. | |
| 8,689,375 | B2 | 4/2014 | Stinchcomb | |
| 8,690,964 | B2 | 4/2014 | Kramer et al. | |
| 8,707,482 | B1 | 4/2014 | Ramthun | |
| 8,910,896 | B2 | 12/2014 | Koskol | |
| 8,911,833 | B2 | 12/2014 | Medoff | |
| 8,911,856 | B2 | 12/2014 | Norris | |
| 9,131,790 | B2 | 9/2015 | Agarwal | |
| 9,259,107 | B2 | 2/2016 | Lilienthal | |
| 9,637,845 | B2 | 5/2017 | Morales | |
| 2002/0088054 | A1 | 7/2002 | McCain et al. | |
| 2002/0157172 | A1 | 10/2002 | Matsushima et al. | |
| 2002/0174945 | A1 | 11/2002 | Fair | |
| 2003/0092339 | A1 | 5/2003 | Covelli | |
| 2003/0190853 | A1 | 10/2003 | Lovingood | |
| 2003/0194938 | A1 | 10/2003 | Efird et al. | |
| 2004/0031098 | A1 | 2/2004 | Hollander | |
| 2004/0040090 | A1 | 3/2004 | Wootten | |
| 2004/0055660 | A1 | 3/2004 | Heiman | |
| 2004/0067706 | A1 | 4/2004 | Woods | |
| 2005/0039937 | A1 | 2/2005 | Yeh et al. | |
| 2005/0042960 | A1 | 2/2005 | Yeh et al. | |
| 2005/0070192 | A1 | 3/2005 | Lorenzotti et al. | |
| 2005/0095939 | A1 | 5/2005 | Heiman | |
| 2005/0109418 | A1 | 5/2005 | Liao | |
| 2006/0014016 | A1 | 1/2006 | Lardizabal et al. | |
| 2006/0180229 | A1 | 8/2006 | Heiman | |
| 2007/0014967 | A1 | 1/2007 | Tingle et al. | |
| 2007/0202763 | A1 | 8/2007 | Shibaoka et al. | |
| 2008/0057813 | A1 | 3/2008 | Tingle et al. | |
| 2008/0096001 | A1 | 4/2008 | Van Emden et al. | |
| 2008/0124533 | A1 | 5/2008 | Bouckaert et al. | |
| 2009/0155601 | A1 | 6/2009 | Lavature et al. | |
| 2009/0260707 | A1 | 10/2009 | Aneja et al. | |
| 2010/0015874 | A1 | 1/2010 | Tingle et al. | |
| 2010/0107339 | A1 | 5/2010 | Stinchcomb | |
| 2011/0111666 | A1 | 5/2011 | Kim | |
| 2011/0133011 | A1 | 6/2011 | Lee et al. | |
| 2012/0009405 | A1 | 1/2012 | Krishnaswamy et al. | |
| 2012/0047624 | A1 | 3/2012 | Hubsmith | |
| 2012/0151894 | A1 * | 6/2012 | Tao | D01H 1/11 57/75 |
| 2012/0157904 | A1 | 6/2012 | Stein | |
| 2012/0186687 | A1 | 7/2012 | Huffstickler et al. | |
| 2012/0253501 | A1 | 10/2012 | Wirth | |
| 2014/0109315 | A1 | 4/2014 | Lilienthal | |
| 2014/0123362 | A1 | 5/2014 | Seitz et al. | |
| 2014/0157575 | A1 | 6/2014 | Stinchcomb | |
| 2014/0166909 | A1 | 6/2014 | Onizawa | |
| 2014/0304922 | A1 | 10/2014 | Kramer et al. | |
| 2014/0310858 | A1 | 10/2014 | Kupiec | |
| 2014/0342970 | A1 | 11/2014 | Kramer et al. | |
| 2015/0026893 | A1 | 1/2015 | Garrett et al. | |
| 2015/0047736 | A1 | 2/2015 | Agarwal | |
| 2015/0184319 | A1 * | 7/2015 | Yeung | D01H 1/025 428/221 |

FOREIGN PATENT DOCUMENTS

| | | | |
|---|---|---|---|
| CN | 1361315 | A | 7/2002 |
| CN | 101385091 | A | 3/2009 |
| CN | 202072865 | U | 12/2011 |
| CN | 203475074 | U | 3/2014 |
| CN | 103820902 | A | 5/2014 |
| EP | 0758692 | A1 | 2/1997 |
| EP | 0913518 | A1 | 5/1999 |
| EP | 1389645 | A2 | 2/2004 |
| EP | 1678358 | A1 | 7/2006 |
| EP | 1400616 | B1 | 2/2007 |
| WO | 2002059407 | A1 | 8/2002 |
| WO | 2005045111 | A1 | 5/2005 |
| WO | 2006062495 | A1 | 6/2006 |
| WO | 2006069007 | A2 | 6/2006 |
| WO | 2006114207 | A1 | 11/2006 |
| WO | 2007133177 | A2 | 11/2007 |
| WO | 2008042082 | A2 | 4/2008 |
| WO | 2009115622 | A1 | 9/2009 |
| WO | 2013148659 | A1 | 10/2013 |

OTHER PUBLICATIONS

"Electromagnetic Shielding Fabrics", LessEMF.com website on Jul. 8, 2015 (pp. 19). http://www.lessemf.com/fabric.html.

"Ultraviolet (UV) Protection of Textiles: A Review", International Scientific Conference, Gabrovo on Nov. 19-20, 2010 by Mine Akgun et al. (pp. 11) http://www.singipedia.com/attachment.php?attatchmentid=1907&d=1296035072.

"Textiles in Electromagnetic Radiation Protection", Journal of Safety Engineering, p-ISSN: 2325-0003 in 2013 by Subhankar Maity et al. (pp. 9) http://www.sapub.org/global/showpaperpdf.aspx?doi=10.5923/j.safety.20130202.01.

"UV Protection Textile Materials", AUTEX Research Journal, vol. 7, No. 1 in Mar. 2007 by D. Saravanan (pp. 10) http://www.autexrj.com/cms/zalaczone_pliki/6-07-1-pdf.

"Fabric structure and design", by N Gokarneshan, 2004 (pp. 152) http://download1121.mediafire.com/87kgl7q913sg/uq77548q3d31hth/Fabric+Structure+Design%28www.amraboikinina.blogspot.com%29.pdf.

A1 Air-jet weaving machine product information, by Dornier, 2011 (pp. 24) https://www.lindauerdornier.com/global/mediathek/brochures/weaving-machine/dornier-air-jet-type-a1-e.pdf.

"Woven Fabrics and Ultraviolet Protection", by Polona Dobnik Dubrovski, Aug. 18, 2010 (pp. 25) https://goo.gl/krjmXe.

"International textile bulletin Yarn and Fabric Forming", 1995 (pp. 11).

"The Modern Textile Dictionary" by George E. Lington, 1954), p. 734, figure/picture 48, Duell, Sloan & Pearce (US) (pp. 3).

"600TC Sheet", by GHCL, Apr. 23, 2010 (pp. 6).

"Test report for Alpha CT-650TC", by Alok Industries Ltd., Jul. 16, 2012 (p. 1).

"Merchandise and Advertising Specification Data Sheet", by JCPenney, Mar. 15, 2010 (pp. 5).

* cited by examiner

PRODUCTION OF HIGH COTTON NUMBER OR LOW DENIER CORE SPUN YARN FOR WEAVING OF REACTIVE FABRIC AND ENHANCED BEDDING

CLAIM OF PRIORITY

This application is a division application of co-pending U.S. patent application Ser. No. 15/069,982 filed on Mar. 15, 2016 and issued as U.S. Pat. No. 9,708,736 on Jul. 18, 2017, and, therefore, claims priority thereto, and incorporates herein by reference the entirety of the disclosure thereof and of each of the priority applications thereof.

FIELD OF TECHNOLOGY

This disclosure relates generally to textiles and, more particularly, to a method, an article of manufacture, device and/or a system of production of high cotton number or low denier core spun yarn for weaving of reactive fabric and enhanced bedding.

BACKGROUND

The comfort of a woven textile against the human skin may be related and/or directly proportional to a thread count. Use of the coarse diameter yarn may lead to a low "thread count" in the woven textile. In contrast, using relatively fine yarns yield a high thread count. A thread count of a textile may be calculated by counting the total weft yarns and warp yarns along two adjacent edges of a square of the woven textile that is one-inch by one-inch. A high thread count may be a commonly recognized indication of the quality of a woven textile, and may also be a measure that consumers associate with tactile satisfaction and opulence.

A core spun yarn that is comprised of a core filament and a sheath may be used in a production of a woven textile to create a new yarn and/or a fabric that has some characteristics of a material of the core filament and some characteristics of a material of the sheath. For example, a core spun yarn comprising a spandex core and a cotton sheath may have an ability to stretch like a spandex polymer, but still retain a set of favorable characteristics of cotton such as a pleasant feeling to human skin and/or an ability resist a sticky sensation. Core spun yarn may also be referred to a "polycore" yarn, and may be created by twisting a set of staple fibers (also known as a roving) and/or a synthetic yarn (e.g., a polyester yarn) around a central filament core that may be made of a synthetic polymer (e.g., polyester, spandex).

Core spun yarns may be used in the production of some woven apparel items, but may not have yet been adapted to the production of bedding fabrics or certain types of fine apparel. When the core filament is reduced in diameter in order to construct a corresponding core spun yarn of reduced diameter, the core filament may break during the process by which the sheath is added to the core filament. A smaller diameter instance of the core filament may also break when fed into a loom apparatus to weave the woven textile. Therefore, use of core spun yarn may be limited to applications that tolerate a low thread count, which may prevent imparting the beneficial characteristics of core spun yarns to a set of woven textiles that require a relatively high thread count to be considered usable, saleable, and/or desirable.

SUMMARY

Disclosed are a method, an article of manufacture, device and/or a system of production of high cotton number or low denier core spun yarn for weaving of reactive fabric and enhanced bedding.

In one aspect, a method of producing a core spun yarn includes drawing a roving thread from a roving bobbin through a roving guide, an aft drafting roller, and a mid drafting roller to a front drafting roller, and drawing a spandex core from a spandex bobbin using a guide roller. The method also includes associating the roving thread and the spandex core by drawing the roving thread and the spandex core in an approximately parallel fashion through the front drafting roller, and drawing the associated roving thread and the spandex core through a lappet hook and an anti-ballooning guide. Further, the method includes winding the drawn associated roving thread and the spandex core on a ring-frame bobbin including a ring traveler attached to a rotatable ring. The ring traveler executes a circular motion around the ring-frame bobbin to cause the drawn associated roving thread to twist around the drawn associated spandex core, forming the core spun yarn.

The methods and devices disclosed herein may be implemented in any means for achieving the various aspects. Other features will be apparent from the accompanying drawings and from the detailed description that follows.

BRIEF DESCRIPTION OF THE DRAWINGS

Example embodiments are illustrated by way of example and not limitation in the Figures of the accompanying drawings, in which like references indicate similar elements and in which.

Figure 1:
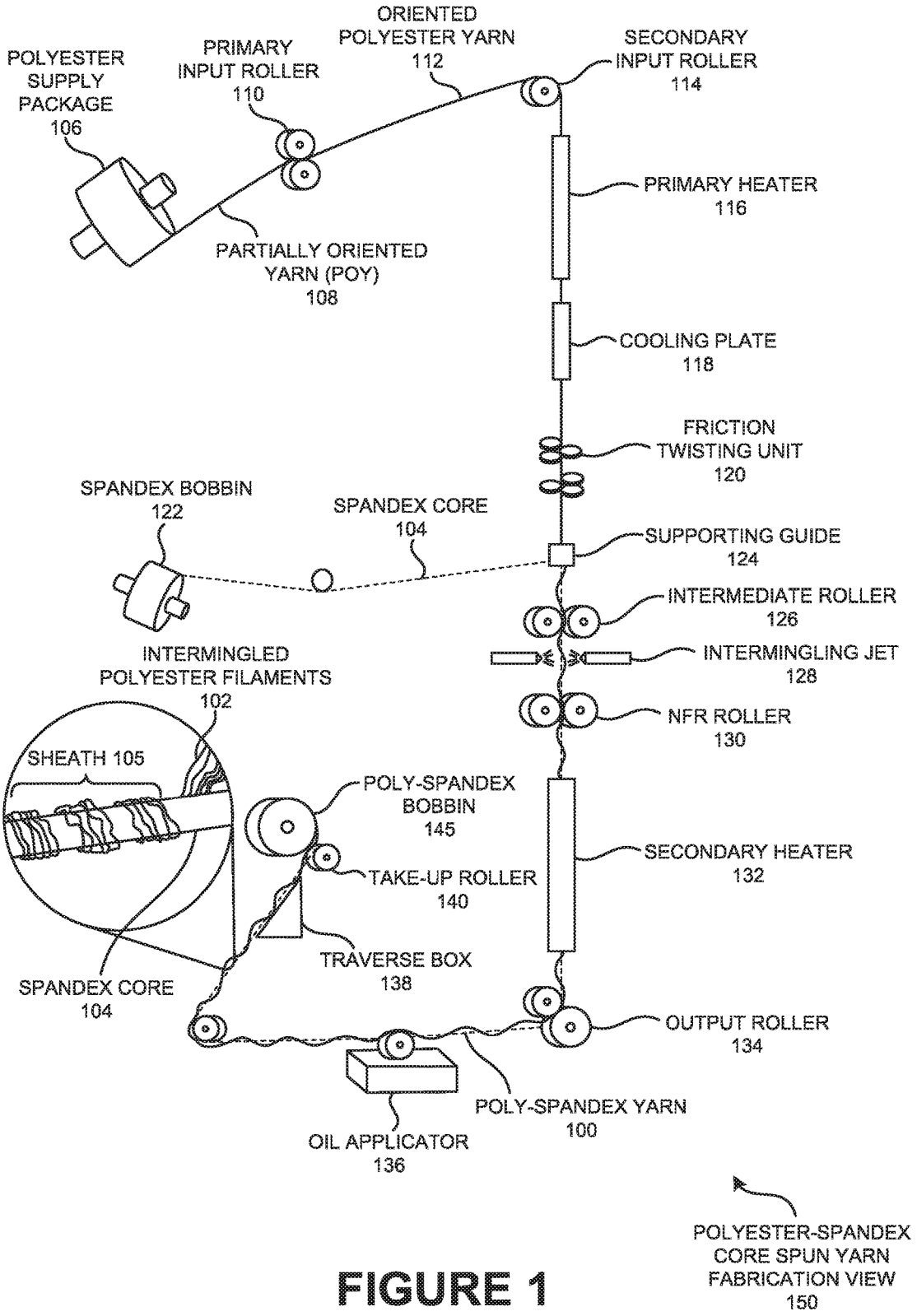
FIG. 1 shows a polyester-spandex core spun yarn fabrication view, including an oriented polyester yarn and a spandex core, according to one embodiment.

Other features of the present embodiments will be apparent from the accompanying drawings and from the detailed description that follows.

DETAILED DESCRIPTION

Example embodiments, as described below, may be used to provide a method, an article of manufacture, device and/or a system of production of high cotton number or low denier core spun yarn for weaving of reactive fabric and enhanced bedding In one embodiment, a method of producing a core spun yarn includes drawing a partially oriented yarn from a polyester supply package through a primary input roller to form an oriented polyester yarn, and drawing the oriented polyester yarn through a secondary input roller. The method further includes drawing the oriented polyester yarn through a primary heater, exposing the oriented polyester yarn to a cooling plate, and drawing the oriented polyester yarn through a friction twisting unit using an intermediate roller. The method also includes drawing a spandex core from a spandex bobbin to become associated with the oriented polyester yarn at a supporting guide located between the friction twisting unit and the intermediate roller.

The method includes drawing both the spandex core and the oriented polyester yarn through an intermingling jet, and texturizing the oriented polyester yarn using the intermingling jet using a hot air punching technique. Also included is twisting the oriented polyester yarn around the spandex core using the intermingling jet and the friction twisting unit, as well as drawing the oriented polyester yarn and the spandex core through a NFR roller after the intermingling jet. Finally, the method includes heating the oriented polyester yarn and the spandex core using a secondary heater to form the core spun yarn.

The primary heater and the secondary heater may be set to a temperature between 50° C. and 200° C. Also, the cooling plate may be set to a temperature between 0° C. and 40° C. The intermingling jet may apply a uniform air pressure to the oriented polyester yarn to provide a counter-twist opposing the friction twisting unit. Additionally, the friction twisting unit may manipulate the oriented polyester yarn such that the oriented polyester yarn gains a texture and/or a weaving stability. Also, the manipulation may include a twisting and/or a detwisting.

The method may include fixing a torsion of the oriented polyester yarn by translating a twist imparted by the friction twisting unit through the oriented polyester yarn back to the primary heater. The secondary input roller may be a twist-stopper preventing the twist from propagating to the polyester supply package. The spandex core may have a denier of 20 to 300.

In another embodiment, a method of producing a core spun yarn includes drawing a roving thread from a roving bobbin through a roving guide, an aft drafting roller, and a mid drafting roller to a front drafting roller. The method further includes drawing a spandex core from a spandex bobbin using a guide roller, associating the roving thread and the spandex core by drawing the roving thread and the spandex core in an approximately parallel fashion through the front drafting roller, and drawing the roving thread and the spandex core through a lappet hook and an anti-ballooning guide. Finally, the method includes winding the roving thread and the spandex core on a ring-frame bobbin including a ring traveler attached to a rotatable ring. A circular motion of the ring traveler around the ring-frame bobbin causes the roving thread to twist around the spandex core, forming the core spun yarn. The roving thread may include cotton staple fibers and/or polyester staple fibers.

In yet another embodiment, a woven textile fabric includes a warp yarn and a weft yarn. The weft yarn is a core spun yarn having a spandex core, and the woven textile fabric is a sateen weave or a plain weave. The woven textile fabric may assume a native state in the absence of external strain, and may assume a first distributed state when experiencing a first strain. Furthermore, the woven textile fabric may assume a second distributed state when experiencing a second strain. The first distributed state may include a slight stretch of the weft yarn which inhibits wrinkles while inhibiting airflow through the woven textile fabric. The second distributed state may include a further stretching of the weft yarn which may permit an enhanced airflow through the woven textile fabric.

The warp yarn may be 100% cotton and have a 60 Ne count, while the core spun yarn may be a roving-spandex yarn and have a 60 Ne count including the spandex core. The spandex core may have a denier from 20 to 300, and the roving-spandex yarn may include a cotton staple sheath and the spandex core. Additionally, the woven textile fabric may also include from 170 to 200 ends per inch of warp yarns, from 100 to 110 picks per inch of the core spun yarn, and a total thread count from 270 to 310. A material content of the woven textile fabric may be approximately 97% to 98% cotton and approximately 2% to 3% spandex, by weight.

Alternatively, the warp yarn may be 60% cotton and 40% polyester and have a 45 Ne count. The core spun yarn may be a roving-spandex yarn and have a 60 Ne count including the spandex core. The spandex core may have a denier of 20 to 300, and the roving-spandex yarn may include a cotton staple sheath and the spandex core. The woven textile fabric may also include from 148 to 170 ends per inch of warp yarns, from 88 to 100 picks per inch of the core spun yarn, and a total thread count from 240 to 270. A material content of the woven textile fabric may be approximately 72% cotton, approximately 25% polyester, and approximately 3% spandex, by weight.

The warp yarn may be 100% cotton and have a 60 Ne count, and the core spun yarn may be a poly-spandex yarn and have a 60 Ne count including the spandex core. The spandex core may have a denier of 20 to 300. The poly-spandex yarn may include the spandex core and a sheath including a set of intermingled polyester filaments derived from a polyester strand, and the poly-spandex yarn may have a denier of at least 95. The woven textile fabric may also include from 170 to 200 ends per inch of warp yarns, from 70 to 80 picks per inch of the core spun yarn, a total thread count from 250 to 270. A material content of the woven textile fabric may be approximately 94% to 95% polyester and approximately 5% to 6% spandex, by weight.

The warp yarn may be 60% cotton and 40% polyester and have a 45 Ne count, while the core spun yarn may be a poly-spandex yarn and have a 90 Ne count including the spandex core. The spandex core may have a denier of 20 to 300. Also, the poly-spandex yarn may include the spandex core and a sheath including a set of intermingled polyester filaments derived from an oriented polyester yarn. The woven textile fabric may also include from 148 to 170 ends per inch of warp yarns, from 88 to 100 picks per inch of the core spun yarn, and a total thread count from 250 to 270. A material content of the woven textile fabric may be approximately 37% cotton, approximately 61% polyester, and approximately 2% spandex, by weight.

FIG. 1 shows a polyester-spandex core spun yarn fabrication view 150, including an oriented polyester yarn and a spandex core, according to one embodiment. Specifically, FIG. 1 shows a poly-spandex yarn 100, a set of intermingled polyester filaments 102, a spandex core 104, a sheath 105, a polyester supply package 106, a partially oriented yarn 108, a primary input roller 110, an oriented polyester yarn 112, a secondary input roller 114, a primary heater 116, a cooling plate 118, a friction twisting unit 120, a spandex bobbin 122, a supporting guide 124, an intermediate roller 126, an intermingling jet 128, an NFR roller 130, a secondary heater 132, an output roller 134, an oil applicator 136, a traverse box 138, a take-up roller 140, and a poly-spandex bobbin 145.

The poly-spandex yarn 100 may be a yarn made out of a combination of polyester and spandex. Polyester is a synthetic resin in which the polymer units are linked by ester groups. Spandex is a type of stretchy polyurethane fabric. The set of intermingled polyester filaments 102 may be a combination of thin polyester strands. The spandex core 104 may be the strand of spandex material which serves as the core of a core spun yarn. The spandex core will be wrapped in a sheath made of a yarn or other material.

The sheath 105 may be a close fitting cover for something, such as a core. By wrapping a core (e.g. a spandex core, etc.) in a sheath made out of a different material (e.g. cotton, polyester, etc.), one may obtain the benefits of both materials. The polyester supply package 106 may be a spool, a reel, or other form of packaging for a polyester thread or yarn. The partially oriented yarn 108 may be polyester yarn as it is just coming off of a container, such as a polyester supply package. The primary input roller 110 may be a roller through which a yarn may pass. The oriented polyester yarn 112 may be a polyester yarn after passing through a primary input roller. The secondary input roller 114 may be a roller through which a yarn may pass. In some embodiments, the secondary input roller 114 may also serve as a twist-stopper that prevents a twist from propagating to the polyester supply package.

The primary heater 116 may be a device for supplying heat to a yarn or thread being drawn through it. The cooling plate 118 may be a device used to chill or cool a thread or yarn which is passing through it. The friction twisting unit 120 may twist/detwist a set of the filaments comprising the oriented polyester yarn 112 such that the oriented polyester yarn 1121 gains a texture (e.g., such that within the resulting textile that the poly-spandex yarn 100 may be woven into gains in "body" and/or heft) and may also provide a low stability interlacing in a weaving process. The friction twisting unit 120 may also help to intermingle the filaments comprising the oriented polyester yarn 112 such that they provide a more uniform and comprehensive instance of the sheath 105.

The spandex bobbin 122 may be a cylinder or cone holding a spandex thread or yarn. The supporting guide 124 may be a guide which facilitates the introduction of the oriented polyester yarn to the polyester core, which may be coming from different directions. The intermediate roller 126 may be a roller which may be used to pull one or more yarns, filaments, and/or threads through a system. The intermingling jet 128 may be an air jet used to texturize, combine, or otherwise manipulate yarns and threads. The NFR roller 130 may be a bearing supported roller type freewheel. In some embodiments, the NFR roller may have no sealing.

The secondary heater 132 may be an additional heater. The output roller 134 may be a roller which may be used to pull a yarn through a process or system. The oil applicator 136 may be a device for the application of conning oil near the end of a yarn fabrication process. The traverse box 138 may be a device which assists in the storage of yarn, such as the core spun yarn being fabricated in FIGS. 1 and 2, on a bobbin. The take-up roller 140 may be a roller which assists in the storage of a yarn. The poly-spandex bobbin 145 may be a bobbin designated for the storage of a poly-spandex yarn.

FIG. 1 is a polyester-spandex core spun yarn fabrication view 150 showing production of a poly-spandex yarn of a core spun construction having a spandex core and a sheath of intermingled polyester filaments derived from an oriented polyester yarn that is twisted around the spandex core by a friction twisting unit and an intermingling yet, the poly-spandex yarn that results being subsequently spun on a poly-spandex bobbin for use in a loom apparatus, according to one or more embodiments.

The poly-spandex yarn 100 comprises a spandex core 104 of a denier of 20 to 300 along with the sheath 105 comprising the intermingled polyester filaments 102. The intermingled polyester filaments 102 are derived from the oriented polyester yarn 112 that is twisted around the spandex core 104. A process of producing the poly-spandex yarn 100 begins by drawing the partially oriented yarn 108 from the polyester supply package 106 to the primary input roller 110. The partially oriented yarn 108 may then be referred to as the oriented polyester yarn 112 which may then enter the secondary input roller 114. The secondary input roller 114 may be a twist-stopper that prevents a twist from propagating to the polyester supply package 106. The oriented polyester yarn 112 may then be drawn through the primary heater 116. The primary heater 116 may be heated to a temperature between 50° C. and 200° C. In one preferred embodiment, the primary heater may be set to 190° C. After leaving the primary heater 116, the oriented polyester yarn 112 may then be exposed to the cooling plate 118 that may be set at a temperature between 0° C. and room temperature (e.g., about 20-25° C.). The cooling plate may also be set at temperatures between 25° C. and 40° C., and in one preferred embodiment 38° C.

The intermediate roller 126 may draw the oriented polyester yarn 112 from the cooling plate 118 to the friction twisting unit 120. The friction twisting unit 120 (e.g., an FTU) may twist/detwist a set of the filaments comprising the oriented polyester yarn 112 such that the oriented polyester yarn 1121 gains a texture (e.g., such that within the resulting textile that the poly-spandex yarn 100 may be woven into gains in "body" and/or heft) and may also provide a low stability interlacing in a weaving process. The friction twisting unit 120 may also help to intermingle the filaments comprising the oriented polyester yarn 112 such that they provide a more uniform and comprehensive instance of the sheath 105. The twist imparted by the friction twisting unit 120 may be translated through the oriented polyester yarn 112 back to the primary heater 116, which, in conjunction with the cooling plate 118, may "fix" the molecular structure of the twisted filaments of the oriented polyester yarn 112, imbuing it with a "memory" of torsion.

The spandex core 104 may be drawn from the spandex bobbin 122 to become associated with the oriented polyester yarn 112 at the supporting guide 124, which may be located between the friction twisting unit 120 and the intermediate roller 126. The intermediate roller 126 may draw both the oriented polyester yarn 112 and the spandex core 104 through the intermingling jet 128. A combination of an action of the intermingling jet 128, which may texturize the oriented polyester yarn 112 through a hot air punching technique, along with the friction twisting unit, may twist the oriented polyester yarn 112 around the spandex core 104. The intermingling jet 128 may apply a uniform air pressure to the oriented polyester yarn 112 in order to provide counter-twist to the friction twisting unit 120. The oriented polyester yarn 112 may then be heated by the secondary heater 132. The secondary heater 132 may be set to between 50° C. and 200° C. In one preferred embodiment, the intermingling jet 115 may be set to a pressure of 2 bars and the secondary heater 132 may be set to a temperature of 170° C. Upon leaving the intermingling jets 128, the oriented polyester yarn 112 and the spandex core 104 may enter the NFR Roller 130, which may be a bearing supported freewheel-type roller without any sealing.

The combination of the spandex core 104 with the oriented polyester yarn 112, upon exiting the secondary heater 132, may be referred to as the poly-spandex yarn 100. The poly-spandex yarn 100 may have a conning oil applied by the oil applicator 136. The conning oil applied by the oil applicator 136 may act as a lubricant, reducing a friction between two or more yarns (e.g., several of the poly-spandex yarns 100) and between one or more yarns and a loom apparatus (e.g., metallic components the poly-spandex yarns 100 may contact). The conning oil may also minimize a static charge formation of synthetic yarns.

After passing the oil applicator 136, the poly-spandex yarn 100 may be drawn through a traverse box 138 by a take-up roller 140 to be wound on the poly-spandex bobbin 145. The poly-spandex bobbin 145 may be fed into a loom apparatus as a weft yarn of a woven textile (e.g., as disclosed above, the third woven textile and/or the fourth woven textile).

Figure 2:
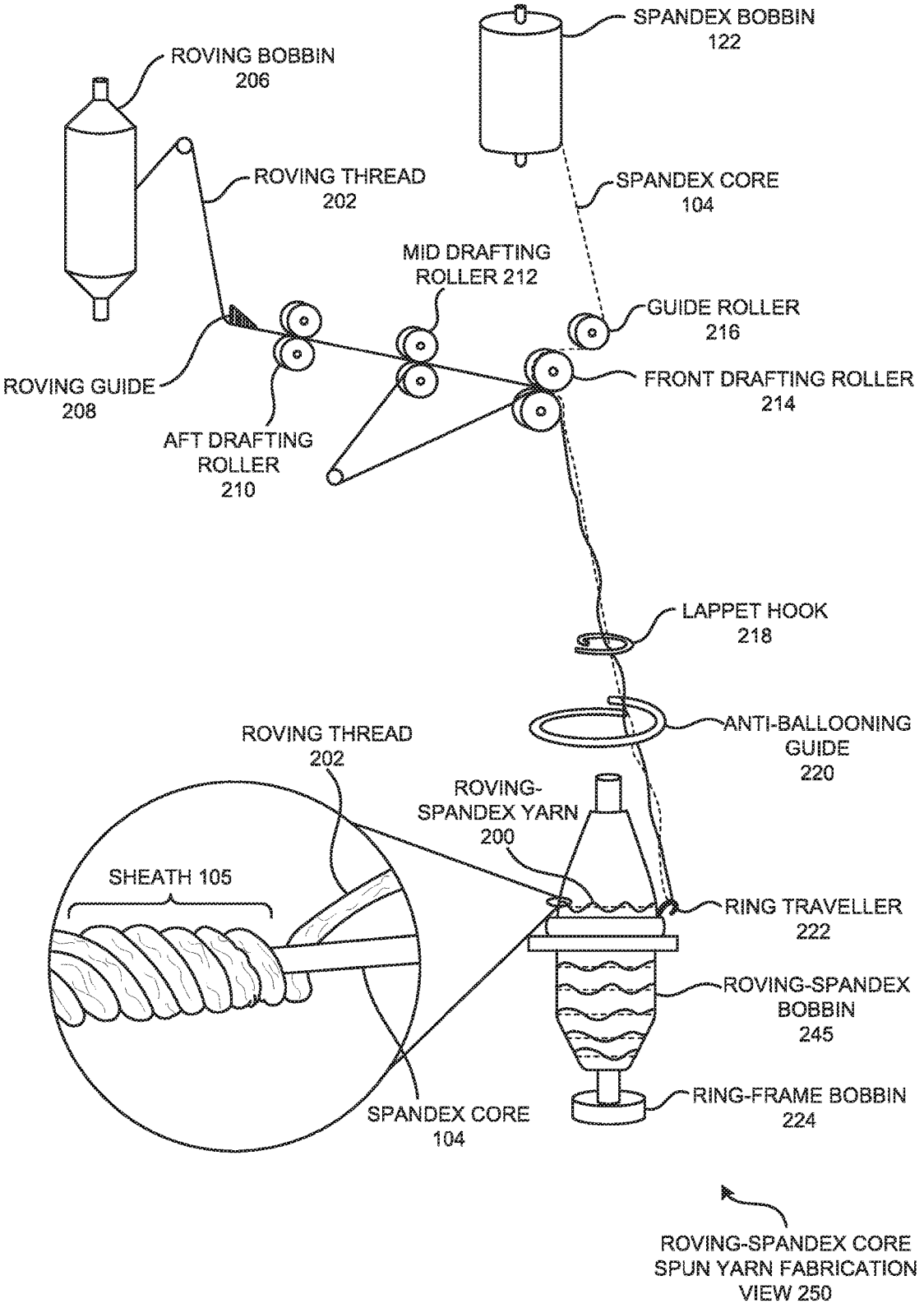
FIG. 2 shows a roving-spandex core spun yarn fabrication view, including a roving thread and a spandex core, according to one embodiment.

FIG. 2 shows a roving-spandex core spun yarn fabrication view 250, including a roving thread and a spandex core, according to one embodiment. Specifically, FIG. 2 shows a roving-spandex yarn 200, a roving thread 202, a roving bobbin 206, a roving guide 208, an aft drafting roller 210, a mid drafting roller 212, a front drafting roller 214, a guide roller 216, a lappet hook 218, an anti-ballooning guide 220, a ring traveler 222, a ring-frame bobbin 224, and a roving-spandex bobbin 245.

The roving-spandex yarn 200 may be a yarn made out of a combination of a roving fiber and a spandex material. The roving thread 202 may be long and narrow bundle of fibers. For example, the roving 202 may be produced during the process of making yarn from raw cotton, polyester fibers, and/or a combination of cotton and polyester fibers. The roving bobbin 206 may be a cylinder or cone which holds a roving. The roving guide 208 may be a device which helps ensure the roving is fed correctly into the aft drafting roller. The aft drafting roller 210 may be the first drafting roller the roving is passed through.

The mid drafting roller 212 and the front drafting roller 214 may be rollers which draw the roving thread into the system, maintaining a proper level of tension to make various properties of the thread uniform. The guide roller 216 may be a roller which assists with the introduction of the spandex core to the roving thread. The lappet hook 218 and the anti-ballooning guide 220 may be devices which assist with maintaining the ballooning of the thread within a certain limit. The ring traveler 222 may be a hook which assists with the winding of the yarn on the bobbin. The roving-spandex bobbin 245 may be a cylinder or cone which may be used to hold a roving-spandex yarn.

The roving-spandex yarn 200 comprises a spandex core 104 of a denier between of 20 to 300 along with the sheath 105 comprising the roving thread 202. Creating a core spun yarn with a 60-80 Ne count may be difficult, and may require long staple yarn fibers, a compact spinning with a high twist. To form the roving-spandex yarn 200, the roving thread 202 is drawn from the roving bobbin 206, through the roving guide 208, the aft drafting roller 210 and the mid drafting roller 212 until it reaches the front drafting roller 214. The roving thread 202 may be a thread made of cotton staple fibers and/or polyester staple fibers. Proximate to a drafting zone associated with the front drafting roller 214, the spandex core 104 is drawn from the spandex bobbin 122 by the guide roller 216. The spandex core 104 and the roving thread 202 may become associated near the drafting zone, and drawn in an approximately parallel fashion through the front drafting roller 214.

The spandex core 104 and the roving thread 202 may then be drawn through the lappet hook 218 and an anti-ballooning guide 220 to be wound on a ring-frame bobbin 224. The ring-frame bobbin 224 uses a ring traveler 222. The ring traveler 222 may be attached to a ring that may rotate. A rapid circular motion of the ring traveler 222 around the ring-frame bobbin 224 may cause the roving thread 202 to twist around the spandex core 104, which may form the sheath 105 of the roving-spandex yarn 200. The ring traveler 222 may then wrap the roving-spandex yarn 200 on the ring-frame bobbin 224 at the same time a spindle of the ring-frame bobbin 245 rotates, forming the roving-spandex bobbin 245.

Figure 3:
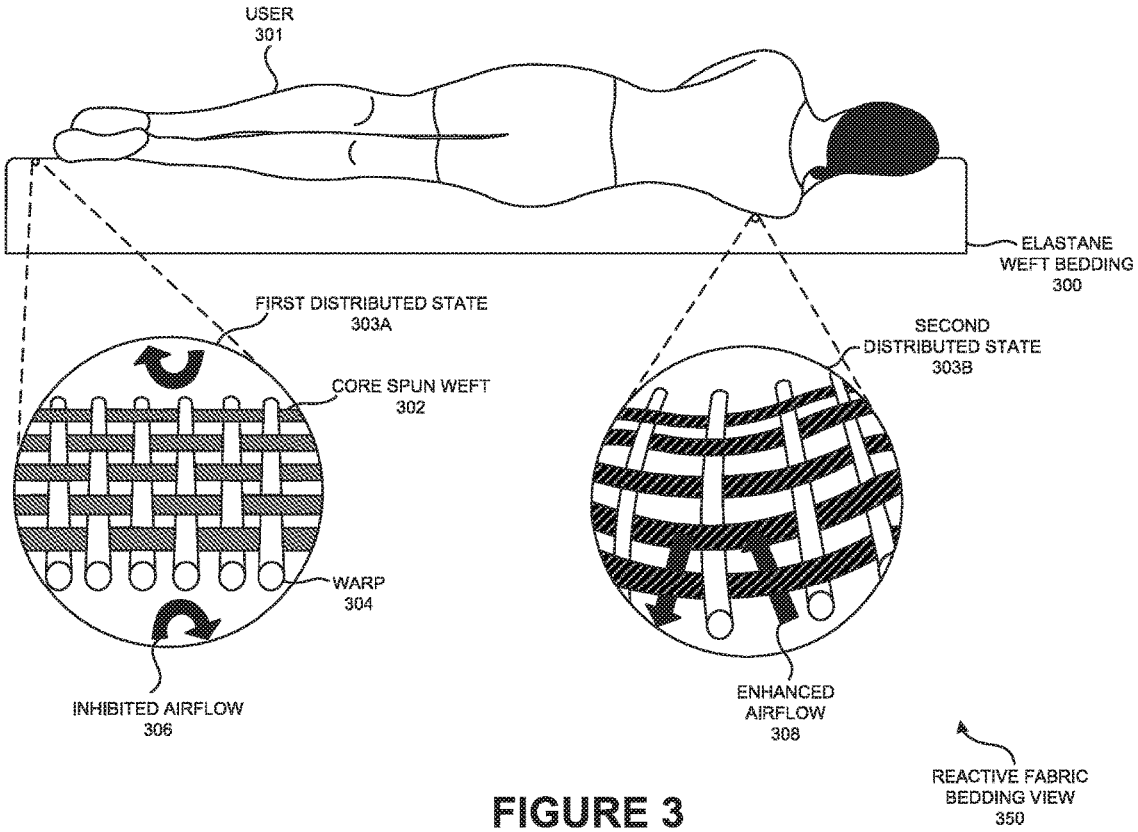
FIG. 3 shows a reactive fabric bedding view showing an elastane weft bedding featuring a core spun yarn, according to one embodiment.

FIG. 3 shows a reactive fabric bedding view 350 showing an elastane weft bedding featuring a core spun yarn, according to one embodiment. Specifically, FIG. 3 shows an elastane weft bedding 300, a user 301, a core spun weft 302, a first distributed state 303A and a second distributed state 303B, a warp 304, an inhibited airflow 306, and an enhanced airflow 308.

The elastane weft bedding 300 may be a bed sheet made from the first woven textile, the second woven textile, the third woven textile, or the fourth woven textile, and which may be a different woven textile also made from the poly-spandex yarn 100 and/or the roving-spandex yarn 200. The user 301 may be a customer, a consumer, a guest at a hotel, or any other individual who may make use of the elastane weft bedding. The core spun weft 302 may be a core spun yarn, such as the polyester-spandex core spun yarn or the roving-spandex core spun yarn, which is being employed as a weft yarn in a textile. The first distributed state 303A and the second distributed state 303B may be states of a textile fabric which may be defined by the degree to which a stretchable weft is being stretched, due to a force being applied (e.g. the strain of being fitted on a mattress, the strain due to a user resting on top of the fabric, etc.) The warp 304 may be the yarn which is interlaced with the weft in a textile fabric. The inhibited airflow 306 may be an air flow that is prevented from passing through the elastane weft bedding. The enhanced airflow 308 may be additional or increased air which flows through the elastane weft bedding.

The present disclosure related to a number of embodiments of the woven textile that have a relatively small diameter of core spun yarn, resulting in a higher thread count and the realization of a reactive fabric that may be used as a bedding (e.g., a bed sheet, a pillow case, a duvet cover) with enhanced comfort and functionality. In one embodiment, a first woven textile comprises from 170 to 200 ends per inch of warp yarns and from 100 to 110 picks per inch of a core spun yarn (the core spun yarn being a weft of the first woven textile fabric) that is a roving-spandex yarn (e.g., the roving-spandex yarn 200 of FIG. 2). A spandex material may also be known as a Lycra™, and/or an elastane. The roving-spandex yarn has a sheath comprising a roving that is a cotton staple and a core that is a spandex core. The total thread count of the first woven textile may be 270 to 310. The first woven textile may have a 100% cotton warp, and the cotton warp may have a 60 Ne Count (Ne may also be known as an "English Cotton Number," a "cotton count," and/or a "count," and may be a measure of the weight in pounds per 840 yard lengths of a yarn). The roving-spandex yarn may have a 60 Ne count, including the spandex core. The spandex core may have a denier of 20 to 300, and in a preferred embodiment between 20 and 60. A material content of the roving-spandex yarn may be 92.0% to 93.0% cotton and 7.0% to 8.0% spandex, by weight. A material content of the first woven textile may be approximately 97.0% to 98.0% cotton and approximately 2.0% to 3.0% spandex, by weight. The first woven textile may have a tensile strength in the warp direction of 40 to 50 kgf/m$^2$ and a tensile strength in the weft direction of 12 to 16 kgf/m$^2$.

In another embodiment, a second woven textile comprises from 148 to 170 ends per inch of warp yarns and from 88 to 100 picks per inch of a core spun yarn (the core spun yarn being a weft of the second woven textile fabric) that is a roving-spandex yarn (e.g., the roving-spandex yarn 200 of FIG. 2). The roving-spandex yarn has a sheath comprising a roving that is a cotton staple and a core that is a spandex core. The total thread count of the second woven textile may be 240 to 270. The second woven textile may have a polyester-cotton warp, and the polyester-cotton warp may have a 45 Ne count. The roving-spandex yarn may have a 60 Ne count, including the spandex core. The cotton-polyester warp may be 60% cotton and 40% polyester. The spandex core may have a denier of 20 to 300. A material content of the roving-spandex yarn may be 92.0% to 93% cotton and 7% to 8% spandex, by weight. A material content of the second woven textile may be approximately 72.0% cotton, approximately 25% polyester, and approximately 3% spandex, by weight. The second woven textile may have a tensile strength in the warp direction of 55 to 65 kgf/m$^2$ and a tensile strength in the weft direction of 15 to 18 kgf/m$^2$.

In yet another embodiment, a third woven textile comprises from 170 to 200 ends per inch of warp yarns and from 70 to 80 picks per inch of a core spun yarn (the core spun yarn being a weft of the third woven textile) that is a poly-spandex yarn (e.g., the poly-spandex yarn 100 of FIG. 1). The poly-spandex yarn has a sheath comprising a set of intermingled polyester filaments derived from a polyester strand and the poly-spandex yarn may have a core that is a spandex core. The total thread count may be 250 to 270. The woven textile may have a cotton warp that is 100% cotton, and the cotton warp may have a 60 Ne count. A denier of the polyester strand may be 75, a denier of the spandex core may be 20, and the denier of the poly-spandex yarn may be about 95. However, the denier of the poly-spandex yarn may be slightly great than 95 due to an increase in a linear density resulting form the twisted structure of the polyester around the spandex core. The spandex core may have a denier of 20 to 300. A material content of the third woven textile may be 94.0% to 95% polyester and 5% to 6% spandex, by weight. The third woven textile may have a tensile strength in the warp direction of 40 to 45 kgf/m$^2$ and a tensile strength in the weft direction of 16 to 20 kgf/m$^2$.

In yet another embodiment, a fourth woven textile comprises from 148 to 170 ends per inch of warp yarns and from 88 to 100 picks per inch of a core spun yarn (the core spun yarn being a weft of the woven textile) that is a poly-spandex yarn (e.g., the poly-spandex yarn 100 of FIG. 1). The poly-spandex yarn has a sheath comprising a set of intermingled polyester filaments derived from an oriented polyester yarn and the poly-spandex yarn may have a core that is a spandex core. The total thread count may be 250 to 270. The fourth woven textile may have a polyester-cotton warp, and the polyester-cotton warp may have a 45 Ne count. The poly-spandex yarn may have a 90 Ne count, including the spandex core (although there is no cotton, the English Cotton Number may still be used as a measure to approximate diameter and/or to measure a linear density). The spandex-polyester warp may be 60% cotton and 40% polyester. The spandex core may have a denier of 20 to 300. A material content of the roving-spandex yarn may be 94.0% to 95% polyester and 5% to 6% spandex, by weight. A material content of the fourth woven textile may be approximately 37.0% cotton, 61.0% polyester, and 2.0% spandex, by weight. The fourth woven textile may have a tensile strength in the warp direction of 50 to 60 kgf/m$^2$ and a tensile strength in the weft direction of 15 to 18 kgf/m$^2$.

The poly-spandex yarn 100 and/or the roving-spandex yarn 200 may be used as a feed yarn for a loom apparatus to form a woven textile (e.g., any of the first woven textile, the second woven textile, the third woven textile, and the fourth woven textile disclosed above). In one preferred embodiment, the loom apparatus is an air jet loom apparatus such as a Picanol Omni Plus® or a Picanol Omni Plus® 800. In the air jet loom apparatus, a picking cycle should be completed as quickly as possible during a weft insertion event. For example, if a normal weft insertion would begin at a pick departure of 75° and end with a pick arrival at 255°, the air jet loom apparatus should be adjusted for the a pick departure of 80° and a pick arrival of 245°. A drive time of a main valve and a relay valve may be increased for usage of a spandex weft. For example, the drive time of the a main valve may be increased from 90° to 150° and the drive time of the relay valve may be increased from 70° to 125°. A pressure of a main nozzle may be increased from 4.5 bars to 5.5 bars, and a pressure of a set of relay nozzles may be increased from 5 bars to 6 bars. For the air jet loom apparatus of Picanal brand, an ELCA holding pressure may be 1.5 kg/cm3 maximum.

A holding pressure of a main nozzle MB (Main Breeze) may be set to 150 KPa, and a tandem nozzle holding pressure may be set per a spandex weft requirement of a manufacturer of the looming apparatus. Additionally, one or more extra instances of the relay nozzle may be added near an end of a side selvedges of the woven textile, after a first filling detector. The extra instance of the relay nozzle may keep the poly-spandex yarn 100 and/or the roving-spandex yarn 200 at a required tension at the end of a picking cycle of the air jet loom apparatus. The loom apparatus may be set up in almost any of a type of weave, but in one preferred embodiment the type of weave used to form the first woven fabric, the second woven fabric, the third woven fabric, and/or the fourth woven fabric may be a sateen weave or a plain weave.

The woven textile that results from the use of the poly-spandex yarn 100 and/or the roving-spandex yarn 200 may be used to form a variety of useful and enhanced products. In one or more primary embodiments, the fabric may be used to for a bedding (e.g., a bed sheet, a pillow case, a duvet cover). The woven textile fabric may increase a sleep experience for several reasons. One reason may be that the woven textile comprised of the poly-spandex yarn 100 and/or the roving-spandex yarn 200 may lend a global stretch effect to the bedding. A lack of wrinkles is associated with a positive sleeping experience. Traditional bed sheets attempt to diminish wrinkles by using elastic bands around the corners of the bed-sheet, two edges of the bed sheet and/or the entire parameter of the bed-sheet, but no stretch effect is imparted to the bed sheet itself. In contrast, the bedding made from poly-spandex yarn 100 and/or the roving-spandex yarn 200 may be able to stretch over the surface of the bed sheet, which may increase comfort as a result of the uniform surface under constant tension from two opposite edges of the sheet.

Another benefit may be that the woven textile comprising poly-spandex yarn 100 and/or the roving-spandex yarn 200 may provide increased comfort as the weight of a person on top of the bed-sheet causes a stretching action in the direction of the core-spun yarn (e.g., the weft), which may temporarily increase the distance between a set of perpendicular yarns forming the weft, creating an enhanced airflow. The enhanced airflow may, among many benefits, cause the bed-sheet to feel cooler and may allow moisture or sweat to dry faster, further causing the comfort against the human skin. In one respect, if the thread count of the bed-sheet textile is defined as the number of yarns in both one inch of the warp direction and one inch of the weft direction when a fabric of the bed-sheet is in a native state, the thread count may decrease when a human weight is placed on, or moves over, the surface of the be bed-sheet due to the stretching of the fabric. However, in this instance a dynamic decreased in thread count experienced in an in-use state, rather than decrease comfort, may increase comfort by increasing a breathability of the bed sheet. Furthermore, no decrease in comfort may occur because the diameter of a core spun weft and a warp of the woven textile do not substantially change.

The advantages of the enhanced bedding are illustrated in FIG. 3. FIG. 3 is a reactive fabric bedding view 350 showing an elastane weft bedding created with either the poly-spandex yarn of FIG. 1 and/or the roving-spandex yarn of FIG. 2, a core spun weft of the elastane weft bedding having a stretch capability that transitions from a native state to a first distributed state that prevents wrinkles when placed in position over a bed, and further transitions from the first distributed state to a second distributed state when weight is placed against the elsastane weft bedding, the second distributed state separating a set of warp yarns to promote an enhanced airflow that causes an improved sleep experience for a user, according to one or more embodiments.

In the embodiment of FIG. 3, the elastane weft bedding 300 may be stretched over a bed of a user 301. Before being placed on the bed, the elastane weft bedding 300 may be in a native state (not shown in the embodiment of FIG. 3) that may represent a least stretched aspect of the core spun weft. Once placed on the bed, the elastane weft bedding 300 may enter the first distributed state 303A wherein the core spun weft 302 may have a slight stretch. The first distributed state 303A may allow the elastane weft bedding 300 to stay secure on the bed and may inhibit wrinkles, promoting a more comfortable sleeping experience. In the first distributed state, the inhibited airflow 306 may still exist as a set of pores between a set of interlacings of the elastane weft bedding may be relatively small. However, when the user 301 lays on top of the elastane weft bedding 300, a location of pressure may cause the elastane weft bedding to enter the second distributed state 303B. The second distributed state 303B may increase the pore size between the interlacings, allowing the enhanced airflow 308 that may further enhance the sleeping experience.

Figure 4:
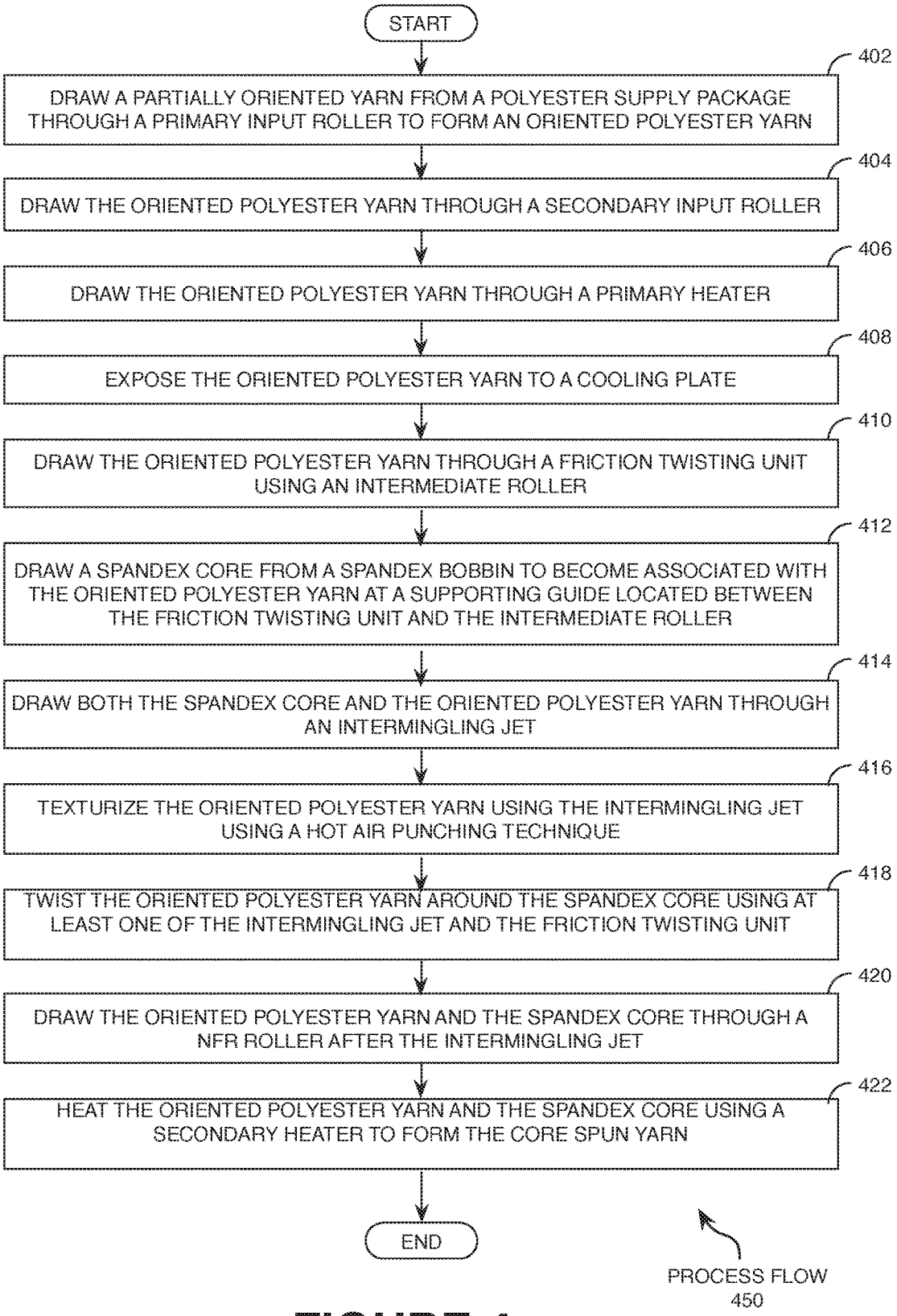
FIG. 4 shows a process flow for the fabrication of the polyester-spandex core spun yarn of FIG. 1, according to one embodiment.

FIG. 4 shows a process flow 450 for the fabrication of the polyester-spandex core spun yarn of FIG. 1, according to one embodiment. In operation 402, a partially oriented yarn may be drawn from a polyester supply package through a primary input roller to form an oriented polyester yarn. In operation 404, the oriented polyester yarn may be drawn through a secondary input roller. In operation 406, the oriented polyester yarn may be drawn through a primary heater. Furthermore, in operation 408, the oriented polyester yarn may be exposed to a cooling plate. In operation 410, the oriented polyester yarn may be drawn through a friction twisting unit using an intermediate roller.

In operation 412, a spandex core may be drawn from a spandex bobbin to become associated with the oriented polyester yarn at a supporting guide located between the friction twisting unit and the intermediate roller. In operation 414, both the spandex core and the oriented polyester yarn may be drawn through an intermingling jet. In operation 416, the oriented polyester yarn may be texturized using the intermingling jet using a hot air punching technique. In operation 418, the oriented polyester yarn may be twisted around the spandex core using at least one of the intermingling jet and the friction twisting unit. In operation 420, the oriented polyester yarn and the spandex core may be drawn through a NFR roller after the intermingling jet. Finally, in operation 422, the oriented polyester yarn and the spandex core may be heated using a secondary heater to form the core spun yarn.

Figure 5:
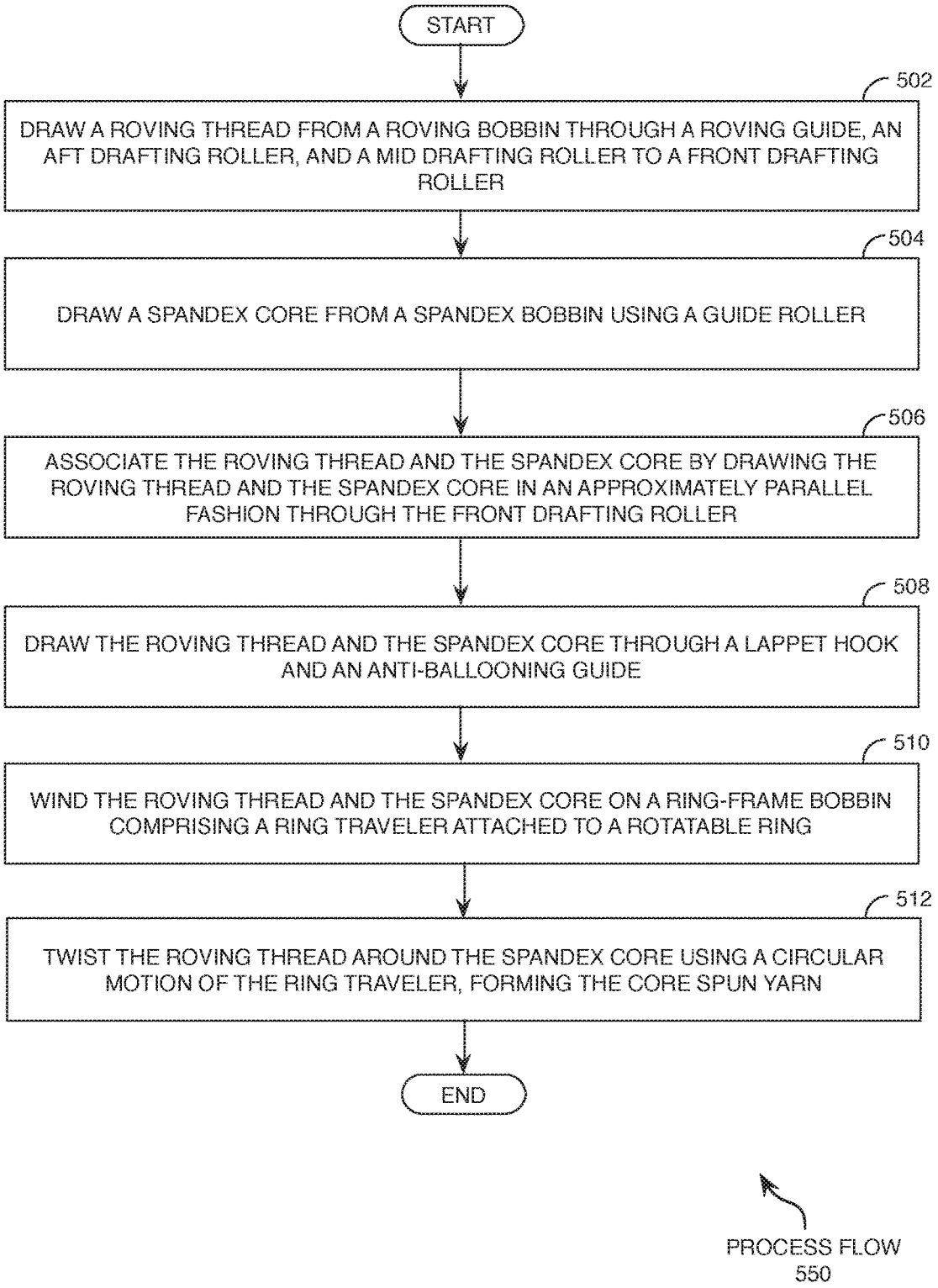
FIG. 5 shows a process flow for the fabrication of the roving-spandex core spun yarn of FIG. 2, according to one embodiment.

FIG. 5 shows a process flow 550 for the fabrication of the roving-spandex core spun yarn of FIG. 2, according to one embodiment. In operation 502, a roving thread may be drawn from a roving bobbin through a roving guide, an aft drafting roller, and a mid drafting roller to a front drafting roller. In operation 504, a spandex core may be drawn from a spandex bobbin using a guide roller. In operation 506, the roving thread and the spandex core may be associated by drawing the roving thread and the spandex core in an approximately parallel fashion through the front drafting roller. In operation 508, the roving thread and the spandex core may be drawn through a lappet hook and an anti-ballooning guide. In operation 510, the roving thread and the spandex core may be wound on a ring-frame bobbin comprising a ring traveler attached to a rotatable ring, wherein a circular motion of the ring traveler around the ring-frame bobbin causes the roving thread to twist around the spandex core, forming the core spun yarn. In operation 512, the roving thread may be twisted around the spandex core using a circular motion of the ring traveler to form the core spun yarn.

The structures and modules in the Figures may be shown as distinct and communicating with only a few specific structures and not others. The structures may be merged with each other, may perform overlapping functions, and may communicate with other structures not shown to be connected in the Figures. Accordingly, the specification and/or drawings may be regarded in an illustrative rather than a restrictive sense.

What is claimed is:

1. A method of producing a core spun yarn, comprising:

drawing a roving thread from a roving bobbin through a roving guide, immediately followed by an aft drafting roller, and immediately followed by a mid drafting roller to a front drafting roller;

drawing a spandex core from a spandex bobbin using a guide roller;

associating the roving thread drawn to the front drafting roller and the spandex core drawn using the guide roller by drawing the roving thread drawn to the front drafting roller and the spandex core drawn using the guide roller in an approximately parallel fashion through the front drafting roller;

drawing the associated roving thread and the spandex core through a lappet hook immediately followed by an anti-ballooning guide, the anti-ballooning guide configured to maintain ballooning of the associated roving thread and the spandex core within a certain limit;

executing, through a ring traveler attached to a rotatable ring, a circular motion around a ring-frame bobbin comprising the ring traveler attached to the rotatable ring to cause the drawn associated roving thread to twist around the drawn associated spandex core, forming the core spun yarn; and wrapping, through the ring traveler, the formed core spun yarn on the ring-frame bobbin at a same time of rotation of a spindle of the ring-frame bobbin to form a roving-spandex bobbin.

2. The method of claim 1, wherein the spandex core has a denier from 20 to 300.

3. The method of claim 1, wherein the roving thread comprises at least one of cotton staple fibers and polyester staple fibers.

* * * * *